United States Patent [19]

Cudini

[11] 4,454,745

[45] Jun. 19, 1984

[54] PROCESS FOR COLD-FORMING A TUBE HAVING A THICK-WALLED END PORTION

[75] Inventor: Ivano G. Cudini, Woodstock, Canada

[73] Assignee: Standard Tube Canada Limited, Woodstock, Canada

[21] Appl. No.: 169,831

[22] Filed: Jul. 16, 1980

[51] Int. Cl.[3] ..... B21K 21/08

[52] U.S. Cl. ..... 72/370; 72/343

[58] Field of Search ..... 72/256, 264, 343, 347, 72/348, 370, 283

[56] References Cited

U.S. PATENT DOCUMENTS

| | | | |
|---|---|---|---|
| 1,945,080 | 1/1934 | Thoms | 72/347 |
| 2,506,657 | 5/1950 | Webster . | |
| 2,917,823 | 12/1959 | Fletcher . | |
| 3,292,408 | 12/1966 | Hill . | |
| 3,807,213 | 4/1974 | Willis et al. . | |
| 3,837,205 | 9/1974 | Simon . | |
| 3,886,649 | 6/1975 | Simon . | |
| 3,948,073 | 4/1976 | Lovell . | |
| 4,292,831 | 10/1981 | Simon | 72/370 |

FOREIGN PATENT DOCUMENTS

| | | | |
|---|---|---|---|
| 28160 | of 1898 | United Kingdom | 72/283 |
| 4661 | of 1912 | United Kingdom | 72/348 |

*Primary Examiner*—Lowell A. Larson

*Attorney, Agent, or Firm*—Ridout & Maybee

[57] ABSTRACT

A tube with a thick walled portion at one end is cold-formed by necking one end of a tube workpiece, inserting a mandrel which engages within the tapering neck of the necked portion, drawing the necked workpiece through a drawing die by applying pressure on the mandrel, and withdrawing the mandrel from the workpiece. A thick-walled portion may be formed at the opposite end by interrupting the drawing operation, inserting a second mandrel of smaller diameter with a shoulder engaging in the tapering neck of the workpiece, continuing the drawing to draw the remainder of the workpiece down onto the second mandrel, and withdrawing the second mandrel.

9 Claims, 19 Drawing Figures

PROCESS FOR COLD-FORMING A TUBE HAVING A THICK-WALLED END PORTION

BACKGROUND OF THE INVENTION

1. Field of the Invention

The present invention relates to a process for forming a tube having a relatively thick-walled end portion. More particularly, the invention relates to a cold forming process for manufacturing such tubes from tube workpieces.

2. Description of the Prior Art

U.S. Pat. No. 3,837,205 dated Sept. 24, 1974 in the name J. A. Simon discloses a process for forming a tube having a relatively thick-walled end portion in which a tube workpiece is extruded through an annular extrusion orifice defined between a circular extrusion opening and a sizing punch having a stepped surface and positioned centrally within the extrusion opening. In an initial extrusion stage, the workpiece is extruded over a relatively large diameter portion of the central sizing punch defining a thin annular orifice, whereby a thin-walled tube section is extruded. Subsequently, the punch is employed in a retracted position, so that a relatively small diameter portion of the punch extends within the extrusion opening and defines a thicker annular orifice, permitting the thick-walled end portion of the tube to be extruded.

With this process, however, the material of the workpiece needs to be subjected to high pressure to commence and maintain plastic flow, and therefore there is considerable frictional energy loss owing to the reaction between the workpiece and the surfaces of the extrusion die and punch. This energy loss is particularly acute as, in order to achieve extrusion, the blank needs to be completely confined with its surfaces in contact with the extrusion ram, the die cavity, and the punch. There is therefore a large surface area of the extrusion die members in rubbing contact with the plastically flowing material of the blank.

SUMMARY OF THE INVENTION

The object of the present invention is to provide a cold-forming process for forming a tube having a thick-walled end portion, with reduced consumption of energy as compared with the above-described process.

The present invention provides a process for forming a tube having a relatively thick-walled end portion, comprising the steps of: providing a tube workpiece whose wall is of substantially uniform thickness; forming a necked end on the workpiece by forcing it into a die having a tapering entrance throat leading to a restricted die orifice, to provide said necked end connected to a main portion of the workpiece by a tapering portion; positioning within the workpiece a mandrel having a shoulder engaging the interior of said tapering portion, and having a main portion which extends within the main portion of the workpiece, said main portion of the mandrel being of diameter greater than the internal diameter of said necked portion; drawing down the wall of the workpiece onto the mandrel to an external diameter conforming to the external diameter of the necked portion by applying force to the mandrel to pass the workpiece together with the mandrel through a drawing die; and withdrawing the mandrel from the workpiece.

With this process, a drawing operation is employed to form at least the thin-walled portion of the tube product, and this drawing operation can be conducted at significantly reduced energy costs as compared with a process requiring extrusion of an equivalent thin-walled tube. In particular, the drawing operation is conducted with considerably less energy loss through friction.

A further advantage as compared with the conventional forging and machining techniques which may be employed for forming a tube having a thick-walled end portion, is that the process of the invention is particularly well adapted for use in a high-speed, automated manufacturing procedure.

Instead of drawing the workpiece together with the mandrel completely through the drawing die, to form a tube having a thick-walled portion at only one end, a tube having a thick-walled portion at each of its ends may be formed by withdrawing the mandrel from the workpiece after passing the workpiece part way through the drawing die. A second mandrel having a shoulder engaging the interior of the tapering portion can then be positioned in the workpiece, the second mandrel having a diameter smaller than the main portion of the first mandrel. The wall of the workpiece is then drawn down onto the second mandrel by forcing the second mandrel together with the workpiece through the drawing die, after which the second mandrel is withdrawn from the workpiece. With this procedure, the second mandrel acts as an internal former, which limits and defines the internal diameter of the thick-walled end portion formed on the end of the workpiece originally remote from the necked end of the workpiece.

BRIEF DESCRIPTION OF THE DRAWINGS

The invention will now be described in more detail, by way of example only, with reference to the accompanying drawings in which.

DESCRIPTION OF THE PREFERRED EMBODIMENT

Figures 1, 2, 3, 4, 5, 6, 7, 8, 9, 10:
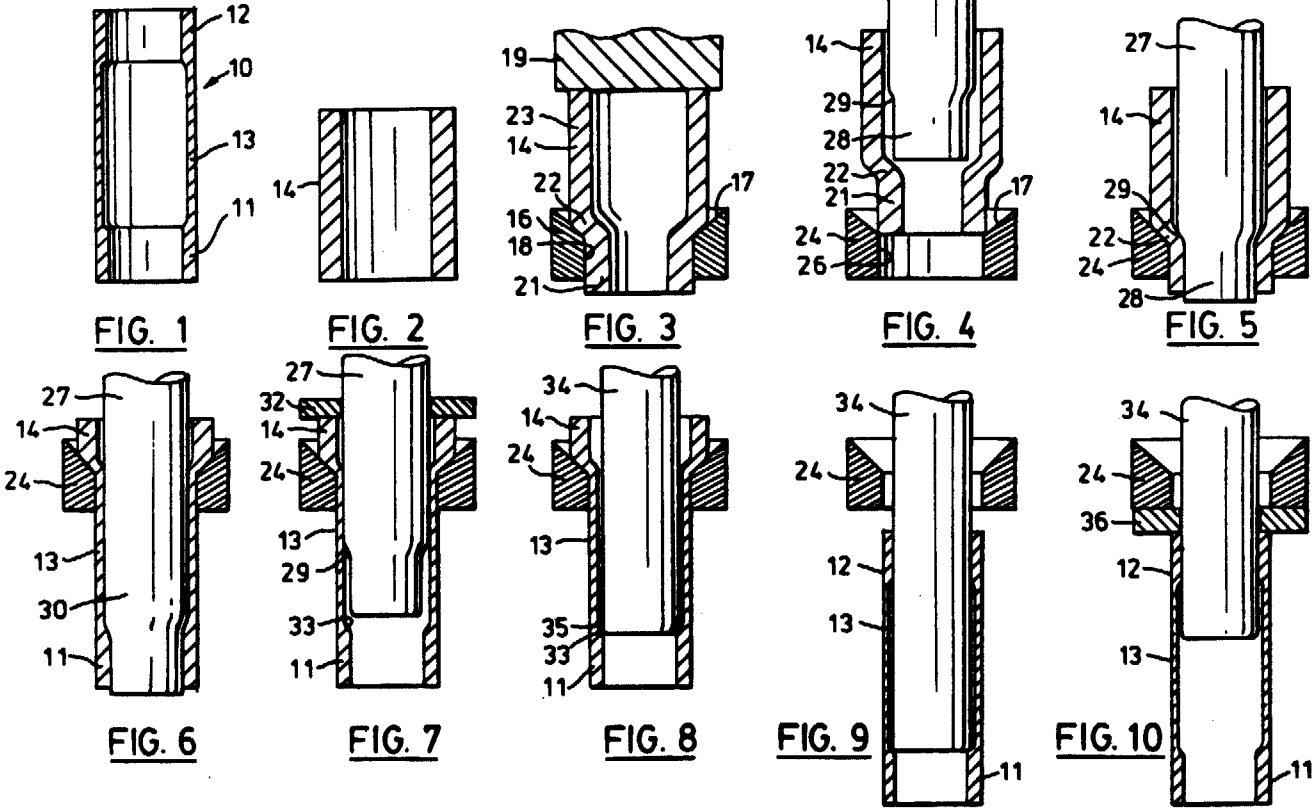
FIG. 1 shows a longitudinal section through a tube product having a thick-walled portion at each of the ends.
FIG. 2 shows a longitudinal section through a tube workpiece.
FIGS. 3 to 10 illustrate successive stages in a preferred form of cold forming process, in accordance with the invention, utilizing the workpiece of FIG. 2.

Referring to the drawings, wherein like reference numerals indicate like parts, FIG. 1 shows a desired tube product 10, comprising thick-walled end portions 11 and 12, and an intermediate wall portion 13.

FIG. 2 shows a tube workpiece 14 having a wall of substantially uniform thickness, from which the tube workpiece 10 of FIG. 1 is to be manufactured. One advantage of the process according to the invention is that the thickness of the wall of the workpiece 14 need not be very precisely controlled, and there can be considerable variation in the thickness of the wall of the tube workpiece 14 along its length, as in the process described hereinafter in more detail, accurate control of the dimensions of the wall of the tube product is maintained even though there may exist considerable variations in the dimensions of the tube workpiece. The dimensions of the tube workpiece 14 can be selected so that this may be readily drawn to form the thick-walled end portion 11, the intermediate portion 13, and the thick-walled end portion 12.

Referring to FIG. 3, in a first stage, the tube workpiece 14 is necked at one end by forcing it into a die 16. This necking die 16 has a tapering entrance throat 17 leading to a restricted die orifice 18. The workpiece 14 is forced into the die 16 by applying pressure from a ram 19 on the opposite end. This forms the workpiece 14 with a necked end 21 having a tapering portion 22 connecting the necked end 21 to a main portion 23 of the workpiece.

The pressure of the ram 19 is applied until a sufficient length of the workpiece 14 has been necked down to form the necked down portion 21. This necked down portion 21 is destined to form the thickened end portion 11 on the final tube product 10, as described in more detail later.

The ram pressure is then removed, and the necked workpiece 14 is withdrawn from the die 16.

The necked workpiece 14 is then positioned in alignment with the die orifice of a drawing die 24, as shown in FIG. 4, having a die orifice 26 of slightly smaller diameter than the die orifice 18 of the die 16. A drawing mandrel 27 is positioned within the necked workpiece 14. The mandrel 27 has a reduced diameter head portion 28 of diameter corresponding to the final inside diameter desired for the thick-walled end portion 11 on the tube product 10. Rearwardly of the head portion 28, the mandrel 27 has a shoulder 29 which as shown is convexly curved to form the interior of the workpiece with a complementary concavely curved shoulder 33. The main portion 30 of the mandrel is of diameter corresponding to the desired internal diameter of the intermediate thin-walled portion 13 of the tube product 10.

As shown in FIG. 5, pressure is applied on the mandrel 27 toward the die 24, so that the shoulder portion 29 of the mandrel engages within the inner surface of the tapering wall portion 22 of the workpiece 14. Continued pressure on the mandrel 27 draws the workpiece 14 downwardly through the die 24, as shown in FIG. 6, with the orifice in the die 24 and the head portion 28 of the mandrel defining between them the dimensions of the thick-walled end portion 11 of the tube product 10. It will be appreciated that during the operation of drawing the necked end 21 of the workpiece through the die 24, the wall of the necked portion is somewhat thinned and lengthened, and therefore the length of the necked portion 21 that is formed in the necking operation shown in FIG. 3 should be made somewhat less than the desired length of the thick-walled portion 11 in the final tube product, to make allowance for the thinning and lengthening that take place during the drawing steps illustrated in FIGS. 5 and 6.

In passage through the drawing die 24, the intermediate portion of the tube workpiece 24 is drawn down between the orifice of the die 24 and the body portion 30 of the mandrel 27, to form the intermediate thin-walled section 13 of the final tube product. At this stage, if desired, the drawing operation shown in FIG. 6 can be continued, so that the workpiece 14 is drawn completely through the orifice of the die 24, producing a tube product having a thick-walled portion 11 at only one end. In the preferred form, however, as illustrated, the drawing operation shown in FIG. 6 is interrupted after the workpiece 14 has been drawn only part way through the die 24, and an annular stripper plate 32 is applied to the end of the workpiece 14 opposite the thick-walled end portion 11, to maintain the workpiece 14 in position within the die 24. The mandrel 27 is then retracted from the workpiece, as shown in FIG. 7. It will be noted that within the interior of the workpiece 14, the portion formerly in contact with the shoulder 29 of the mandrel 27 is formed with an annular shoulder 33 which is concavely curved in section.

After the mandrel 27 has been withdrawn, a second mandrel 34 is inserted into the workpiece 14, as shown in FIG. 8, the mandrel 34 having a convexly curved shoulder 35 at its leading end engaging with the concave shoulder 33 of the workpiece. The diameter of the second mandrel 34 corresponds to the interior diameter desired for the second thick-walled end portion 12 in the final tube product 10. Pressure is applied to the second mandrel 34 to draw the workpiece through the drawing die 24, as shown in FIG. 9. As the previously unformed portion of the workpiece 14 passes through the orifice of the die 24, the workpiece is drawn down on to the second mandrel 34, thus forming the upper end portion 12 to the desired inside diameter.

It will be noted that the inside diameter of the end portion 11 will be slightly smaller than the inside diameter of end portion 12. Further, in the region of the tube product that is adjacent to the die orifice 26 at the time of the change-over from the thicker mandrel 27 to the thinner mandrel 34, there will be formed on the outer surface of the tube a circumferential groove or depression resulting from inward collapse of the partially-drawn metal onto the thinner mandrel 34 when the drawing operation is recommenced. The wall thickness in this grooved transitional region remains the same as or slightly greater than the thickness of the intermediate drawn portion 13.

As shown in FIG. 10, after drawing the tube completely through the die 24, a stripper plate 36 is then positioned between the end portion 12 and the die. The stripper plate 36 is formed in sections so that it may be inserted around the mandrel 34 in abutment with the upper end of the thick-walled portion 12 of the workpiece.

The mandrel 34 is withdrawn from the workpiece, as shown in FIG. 10, and the finished tube product can then be removed from the forming apparatus.

It will be appreciated that during the necking operation shown in FIG. 3, the wall of the lower end of the workpiece 21 is thickened and lengthened. In a modification of the procedure described above, by initially selecting the tube workpiece 14 of an appropriate wall thickness, a lower thick-walled end portion 11 is formed directly by the necking operation of FIG. 3, and, following withdrawal of the ram 19, the mandrel 27 is inserted within the necked workpiece, and the drawing operation, as illustrated in FIGS. 5 through 9, is continued within the die 16, so that the same die 16 is used not only for the necking operation but also for the drawing operations. Normally, however, it is not convenient to provide a tube workpiece 14 of an initial wall thickness such that the end portion 11 can be formed directly by necking in the die 16, and therefore the procedure described above in detail is adopted, wherein one end of the workpiece is initially necked to an outside diameter slightly larger than the outside diameter of the final product and the end portion 11 is drawn to its desired final dimensions using the separate drawing die 26.

Figures 11, 12, 13, 14, 15, 16, 17, 18, 19:
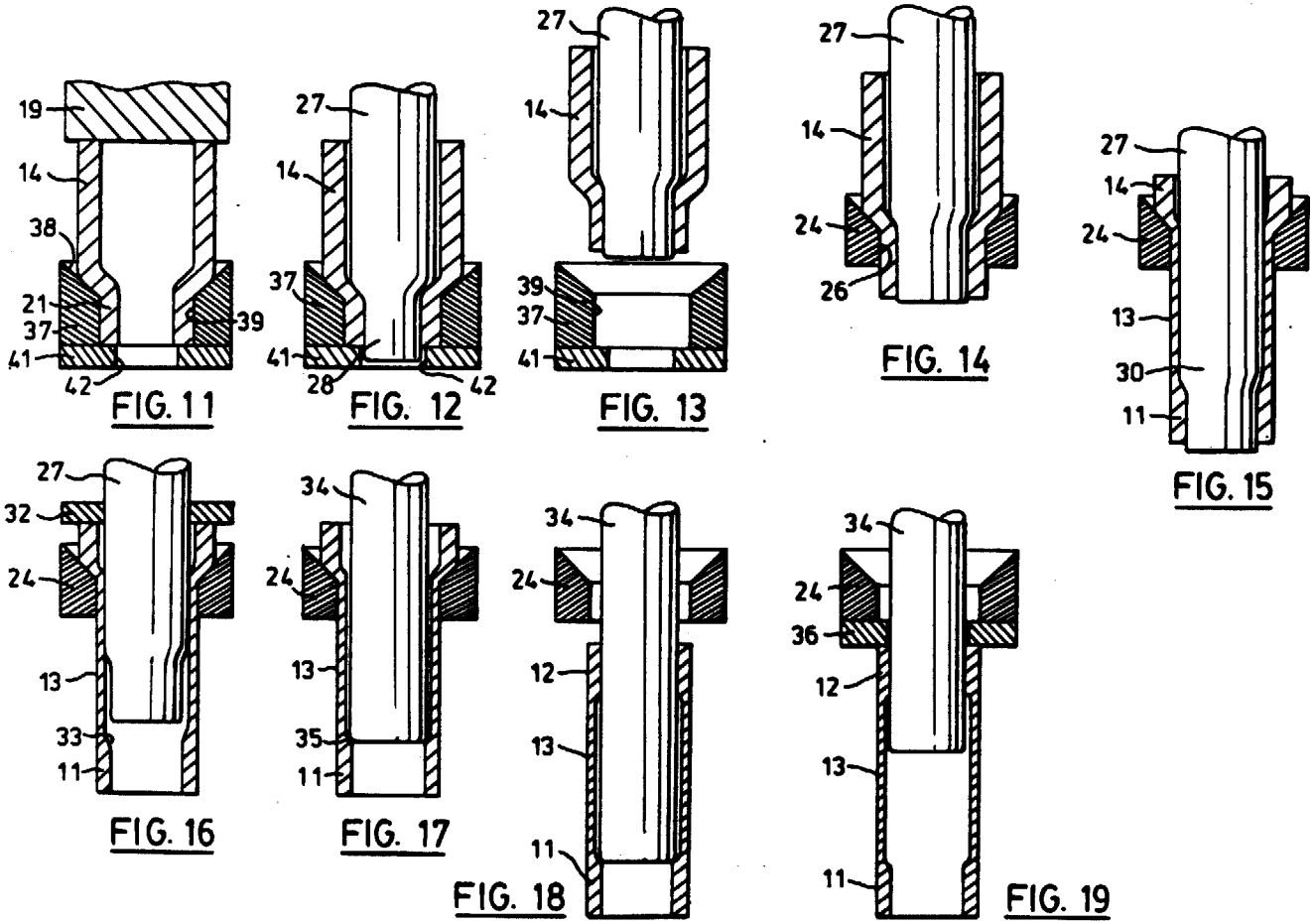
FIGS. 11 to 19 illustrate successive stages in a further form of cold forming process.

In a further modification, illustrated in FIGS. 11 through 19, the tube workpiece 14 is necked in a necking die 37 having a tapering entrance throat 38 and a constant diameter die orifice 39 terminating at an abutment surface provided by a stop plate 41 formed with a central aperture 42. The wall of the necked end portion 21 is then thinned by a back-extrusion operation in which, as shown in FIG. 12, the mandrel 27 is forced into the necked workpiece 14 within the die 37, with the head portion 28 of the mandrel entering the aperture 42 in the stop plate 41 to exert extrusion pressures on the necked portion 21 which is at this time confined between the die orifice 39, and the surface of the stop plate 41 bordering the aperture 42. The mandrel 27 together with the workpiece 14 is then removed from the die 37, as shown in FIG. 13, and is inserted into the drawing die 24, the die orifice 26 of which is of slightly smaller diameter than the die orifice 39 of the necking die 37. The drawing operation then proceeds in an identical fashion to that described above with reference to FIGS. 5 to 10 of the accompanying drawings, to which description reference should be made for further details.

Although the above description provides ample information to one skilled in the art to conduct a tube-forming process in accordance with the invention, merely for the avoidance of doubt a detailed example of a tube-forming process employing the procedures described above in detail with reference to FIGS. 1 to 10 will be given.

EXAMPLE

A tube workpiece 14 of SAE 1020 steel 15.75 inches long, 3.25 inches outside diameter and 0.25 inches wall thickness is subjected to necking in a necking die 16 having an entrance throat 17 tapering from a diameter of 3.37 inches to a diameter of 2.99 inches over a length of 1 inch measured parallel to the axis of the die. The die orifice 18 is of 2.99 inches constant diameter, extending for a length of 0.5 inches. Ram pressure was applied with the ram 19 until a necked down portion of about 1.19 inches length was formed. As a result, the necked down portion has an external diameter of 2.99 inches and an internal diameter of about 2.5 inches.

The necked down tube was then drawn through a die 24 having a die orifice 26 of 2.96 inches diameter, employing a mandrel 27 having a head portion 28 of diameter 2.48 inches and length 2.12 inches, with a curved shoulder portion 29 of 0.08 inch radius connecting the head portion 28 to a body portion 30 of 2.64 inch diameter. The mandrel 27 together with the workpiece 14 was drawn through the die 24 until the length of the workpiece drawn through the die, measured from the tip of the thickened end portion 11 to the junction of the drawn wall 13 and the unformed portion of the workpiece 14 measured 20.65 inches. A pressure of about 130,000 pounds was applied to the mandrel 27 during this drawing operation.

After withdrawal of the mandrel 27, a second mandrel 34 having a short head portion of 0.5 inches length and 2.48 inches in diameter, joined to the main portion of the mandrel 34 at a curved shoulder of 0.8 inches radius was inserted. The diameter of the main portion of the mandrel 34 was 2.58 inches. The remaining portion of the workpiece was then drawn through the die 24, as shown in FIGS. 8 and 9, employing a maximum drawing pressure on the mandrel 34 of about 90,000 pounds.

The final tube product had a thickened end portion 11 of length 1.87 inches with an inside diameter of 2.48 inches. The overall length of the tube was 24.77 inches, with a constant outer diameter of 2.96 inches. The intermediate portion 13 had an inside diameter of 2.64 inches, and the thick-walled end portion 12 was of length 4.12 inches, with an inside diameter of 2.58 inches. The cross-sectional area of the intermediate portion 13 was thus reduced by approximately 40% as compared with the cross-sectioned area of the metal wall of the original tube workpiece 14. It will be appreciated that this cold working of the product resulted in a considerable increase in its yield strength as compared with that of the original workpiece.

The tube product having a strong but thin walled intermediate portion and thick-walled end portions is thus well adapted for use in the manufacture of a lightweight axle for road vehicles.

Although in the above description reference has been made to pressure applied to the ram 19 and to the mandrels 27 and 34, it will be appreciated that the process may alternatively be carried out by holding the rams 19 and the mandrels 27 and 34 fixed, and in such case the dies 16, 24, and 37 are movable, and equivalent pressures are applied to these dies.

I claim:

1. Process for forming a tube having a relatively thick-walled end portion, comprising the steps of: providing a tube workpiece having an opening at each end and whose wall is of substantially uniform thickness; forcing an undeformed end face of the workpiece into a die having a tapering entrance throat leading to a restricted die orifice of diameter intermediate the external and internal diameters of the workpiece, to provide the workpiece with a necked end portion of external diameter greater than the internal diameter of the workpiece and connected to a main portion of the workpiece by a tapering portion; positioning within the workpiece a first mandrel having a head portion for engaging within the interior of the necked portion and a shoulder engaging the interior of said tapering portion, and having a main portion which extends within the main portion of the workpiece, said main portion of the mandrel being of diameter intermediate the external and internal diameters of said necked portion; thinning and drawing down onto the mandrel the wall of at least a major portion of the length the workpiece extending rearwardly from the necked portion to bring the necked portion and said at least major portion of the wall of the workpiece to the same external diameter by applying force to the mandrel to pass the workpiece together with the mandrel only part way through a drawing die with an orifice no larger than the external diameter of the necked portion; the orifice of said drawing die and said mandrel being sized so as to effect between them an at least about 30% reduction in the cross-sectional area of the drawn workpiece as compared with the original workpiece; applying an abutment member to the end of the workpiece remote from said necked end; retracting the mandrel from the workpiece while holding the workpiece against the abutment member to thereby withdraw the mandrel from the workpiece without altering the dimensions of the workpiece, inserting into the part-drawn workpiece a second mandrel of diameter smaller than the main portion of the first mandrel, the second mandrel having a shoulder portion engaging the interior of the tapering portion of the workpiece, drawing the workpiece together with the second mandrel through a drawing die by applying force to the second mandrel; and withdrawing the second mandrel from the workpiece without altering the dimensions of the workpiece by engaging its end opposite from the necked portion with an abutment member and retracting the second mandrel.

2. Process as claimed in claim 1 wherein the workpiece is forced into the first-mentioned die by applying ram pressure on the end opposite the end to be necked down.

3. Process as claimed in claim 1 wherein the same die is used for necking said one end and for drawing down the workpiece onto the mandrel.

4. Process as claimed in claim 1 wherein separate dies are used for necking said one end and for drawing down the workpiece onto the mandrel, respectively.

5. Process as claimed in claim 4 including the steps of withdrawing the necked workpiece from the first-mentioned die before inserting said mandrel within the workpiece, said mandrel having a head portion engaging within and conforming to the interior of the necked portion.

6. Process as claimed in claim 5 wherein the die orifice of the drawing die is of slightly smaller diameter than the die orifice of the necking die, whereby the necked portion and main portion of the workpiece are drawn down to a uniform external diameter.

7. Process for forming a tube having a relatively thick-walled portion at each of its ends, comprising the steps of: providing a tube workpiece which has an opening at each end and is necked at one end to an external diameter intermediate the external and internal diameters of the workpiece, said necked end portion being connected to a main portion of the tube by a tapering portion, said main portion having a tube wall of substantially uniform thickness; positioning within the workpiece a first mandrel having a head portion extending within the necked portion, an annular shoulder which is convex in section engaging the interior of said tapering portion, and a main portion extending within the main portion of the workpiece, said main portion of the mandrel being of diameter intermediate the external and internal diameters of the necked portion; thinning and drawing down onto the mandrel and intermediate length of the wall of the main portion of the workpiece to bring the intermediate length and the necked portion to the same external diameter by applying force to the mandrel to pass the workpiece together with the mandrel part way through a drawing die with an orifice no larger than the external diameter of the necked portion and to form the interior of the workpiece with an annular shoulder which is concave in section; the orifice of said drawing die and said mandrel being sized so as to effect between them an at least about 30% reduction in the cross-sectional area of the drawn workpiece as compared with the original workpiece; withdrawing the first mandrel from the workpiece without altering the dimensions of the workpiece by engaging its end opposite from the necked portion with an abutment member and retracting the mandrel from the workpiece; positioning within the workpiece a second mandrel having an annular shoulder convex in section engaging the interior of said concave shoulder and having a main portion, of diameter intermediate the internal diameters of the necked portion and said intermediate length of the workpiece, extending within the main portion of the workpiece, drawing down the wall of the workpiece on to the second mandrel to a uniform external diameter conforming to the external diameter of the necked portion and of said intermediate length by applying force to the second mandrel to pass the workpiece together with the second mandrel completely through a drawing die with an orifice no larger than that of the first-mentioned drawing die; and withdrawing the second mandrel from the workpiece without altering the dimensions of the workpiece by engaging its end opposite from the necked end with an abutment member and retracting the mandrel from the workpiece.

8. Process as claimed in claim 1 or claim 7 including the step of holding the part-drawn workpiece in the drawing die while withdrawing the first mandrel therefrom.

9. Process as claimed in claim 1 or claim 7 including the step of retaining the workpiece with the abutment member interposed between the workpiece and the drawing die while withdrawing the second mandrel from the workpiece.

* * * * *